US006508193B2

(12) United States Patent
De Quatrebarbes

(10) Patent No.: US 6,508,193 B2
(45) Date of Patent: Jan. 21, 2003

(54) SHIELDING DEVICE FOR PROTECTION OF FLOATERS OF AN INFLATABLE BOAT

(75) Inventor: Ivan De Quatrebarbes, Mer (FR)

(73) Assignee: Sillinger, Mer (FR)

( * ) Notice: Subject to any disclaimer, the term of this patent is extended or adjusted under 35 U.S.C. 154(b) by 0 days.

(21) Appl. No.: 09/973,084

(22) Filed: Oct. 10, 2001

(65) Prior Publication Data

US 2002/0053314 A1 May 9, 2002

(30) Foreign Application Priority Data

Oct. 12, 2000 (FR) ..... 00 13068

(51) Int. Cl.[7] ..... B63B 7/00

(52) U.S. Cl. ..... 114/345; 114/9; 114/11; 441/40

(58) Field of Search ..... 114/9, 11, 14, 114/345; 441/40

(56) References Cited

U.S. PATENT DOCUMENTS 3,935,607 A * 2/1976 Cantwell et al. ..... 114/345
4,329,751 A * 5/1982 Cigognetti ..... 114/345
4,879,165 A 11/1989 Smith
5,113,779 A * 5/1992 Amrein et al. ..... 114/68
5,200,256 A 4/1993 Dunbar
5,540,117 A * 7/1996 Masters ..... 114/361
5,789,327 A 8/1998 Rousseau
5,832,857 A 11/1998 McPherson
5,878,685 A 3/1999 Hemphill et al.

FOREIGN PATENT DOCUMENTS

GB 2221976 2/1990
WO WO 98/46422 10/1998

* cited by examiner

*Primary Examiner*—Jesus D. Sotelo
(74) *Attorney, Agent, or Firm*—Leydig, Voit & Mayer, Ltd.

(57) ABSTRACT

A device for shielding floaters of an inflatable boat includes shielding plates for fastening in a juxtaposed arrangement to external faces of the floaters along their entire length and made of a light material which is resistant to the impacts of ordnance.

14 Claims, 2 Drawing Sheets

1
2
3
4
5
6
7
8
10
11
II

SHIELDING DEVICE FOR PROTECTION OF FLOATERS OF AN INFLATABLE BOAT

FIELD OF THE INVENTION

The present invention concerns a device for protection by shielding an inflatable boat with floaters.

BACKGROUND

Various solutions have already been proposed to shield floating craft against powerful shoulder-held weapons.

One of these solutions consists of using a shielding material made of Kevlar in the form of a flexible fabric which, while not causing any large excess weight of the craft, is not sufficiently resistant to the impact of ordnance, for example, of calibers NATO 7.62, NATO 5.56, or 7.62×39.

Another known solution consists of using shielding material based on ceramics or a metal alloy which is sufficiently resistant to impacts of ordnance, but which causes a high excess weight of the craft, due to its relatively high weight per $m^2$.

In addition, the various means used to date to fasten the shielding device to the hull of the craft are relatively complex and expensive.

SUMMARY OF THE INVENTION

The purpose of the present invention is to eliminate the above drawbacks by proposing a device for protection by shielding an inflatable boat with floaters comprising shielding plates which are fastened, in a juxtaposed arrangement, to the external faces of the floaters along their entire length, and which are made of a light material which is resistant to impacts of ordnance.

It is preferred for each shielding plate to be fastened in a removable manner to the external side of the corresponding floater by at least one strap which transversely holds the plate to the floater by being passed through an attachment ring which is fastened to the floater under the bottom part of the plate and whose two free ends are engaged in two tightening rings fastened to the internal face of the floater located inside the boat.

Advantageously, each shielding plate is fastened to the external face of the corresponding floater by two longitudinally spaced straps transversely holding the plate to the floater by being passed through two attachment rings fastened to the floater, respectively, under the bottom part of the plate, where the two free ends of each strap are engaged in two fastening rings attached to the internal side of the floater located inside the boat.

Each shielding plate is enclosed in a cover made of fabric and each strap made of fabric has an internal strand which is fastened by sewing to the internal face of the cover which is in contact with the external face of the floater, and its external strand is in contact with the external face of the cover.

It is preferred for the cover to be made of a fabric based on Hypalon™ and neoprene.

The adjacent shielding plates are fastened to each other by detachable connection means.

It is preferred for each connection means connecting two adjacent shielding plates to comprise a strap which extends longitudinally with respect to the floater and which has one of its ends fastened by sewing to the external side of the cover containing one of the two adjacent shielding plates, while the opposite end of the strap engages in two tightening rings integrally connected to the external face of the other adjacent shielding plate by traversing its associated cover.

Each strap for connecting two adjacent shielding plates has one end sewn to the cover which is directed toward the front of the boat and its opposite end is engaged in the two rings directed toward the back of the boat.

The shielding plates are made by molding and they match the external shape of the floater.

Advantageously, the shielding plates descend approximately to the flotation line of the boat.

Each shielding plate is made of a composite material based on polyethylene with unidirectional fibers and vinyl ester resin.

The composite material comprises approximately 80 wt % polyethylene and approximately 20 wt % resin.

The material advantageously comprises four layers of polyethylene fibers with the unidirection fibers of a layer oriented at 90° with respect to the unidirectional fibers of an adjacent layer.

The material has a weight of 17 kg per $m^2$.

BRIEF DESCRIPTION OF THE DRAWING

The invention will be better understood, and other purposes, characteristics, details and advantages of the invention will become more apparent in the explanatory description made below with reference to the schematic drawings which are only given as examples, illustrating an embodiment of the invention, in which.

DETAILED DESCRIPTION

Figures 1, 2:
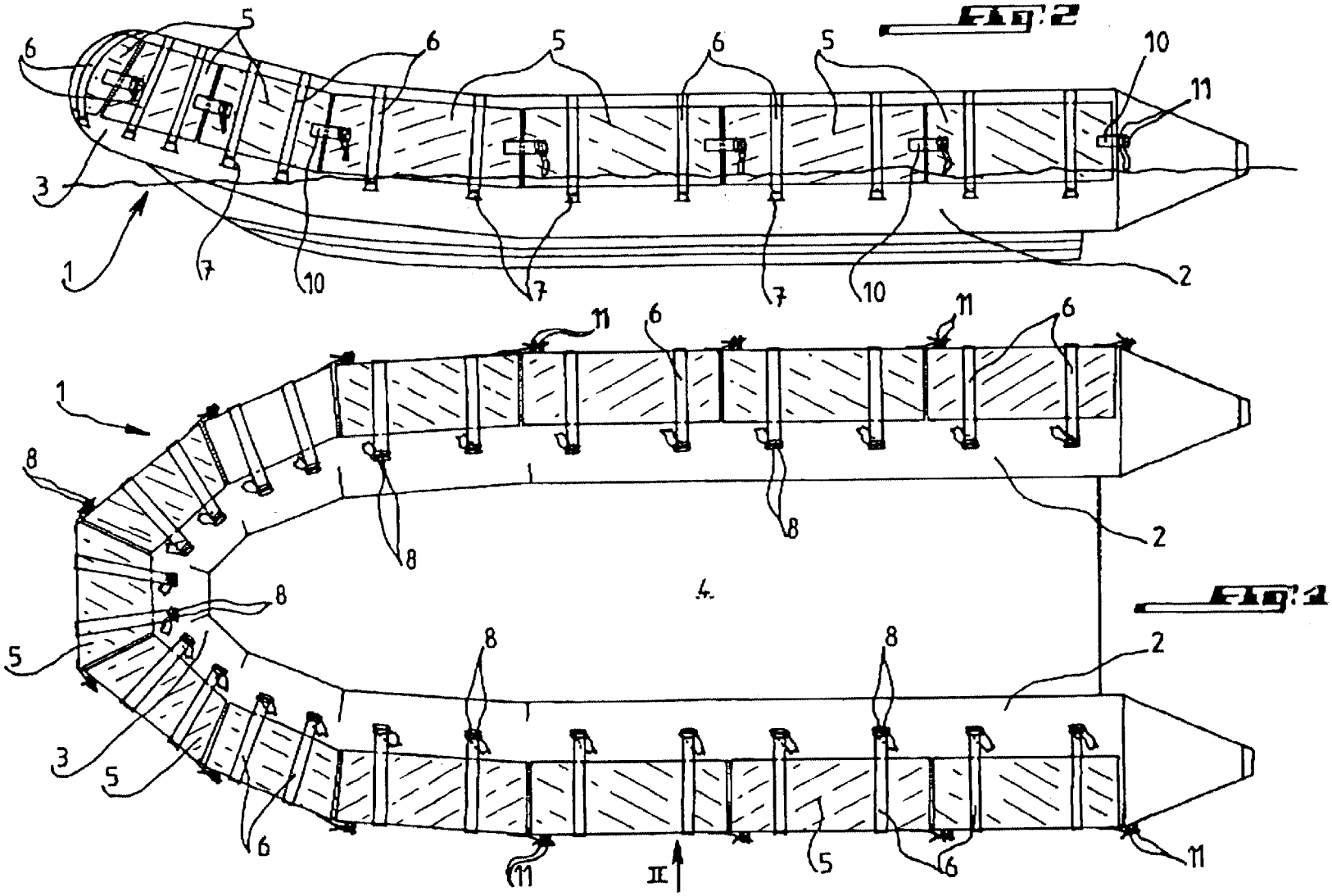
FIG. 1 is a top view of an inflatable boat comprising the shielding device of the invention.
FIG. 2 is a side view along the arrow II of the boat of FIG. 1.

With reference to the figures, reference numeral 1 denotes an inflatable boat of the type with floaters comprising, in this case, two lateral floaters 2 and a front floater 3 having a substantially curved shape, connecting the two lateral floaters 2. The floaters 2, 3 can be made of a single part in which air is inflated as is known.

The floaters 2, 3 are connected to each other, at their bottom part, by a part 4 forming the transport floor for persons.

The inflatable boat 1 is driven by a heat engine (not shown) located in the back of the boat.

In addition, the floaters 2, 3 can be of the type with cylindrical envelopes or sausages.

According to the invention, the inflatable boat 1 comprises a device for the protection by shielding of the floaters 2, 3.

This shielding device consists of shielding plates 5 which are fastened in a removable manner and in a juxtaposed arrangement to the external faces of the floaters along their entire length.

More specifically, each shielding plate 5, which is preferably made by molding, in part matches the external shape of the corresponding floater and it is fastened to it by two straps 6 which are longitudinally separated, each transversely holding the plate 5 to the floater.

Each fastening strap 6 passes through an attachment ring 7 fastened to the floater under the bottom part of the plate 5, and the two free ends of the two strands of the strap located on each side of the plate 5 engage in two rings 8 which are parallel and close to each other to allow tightening of the strap by pulling at its two ends, as is known.

The two tightening and locking rings 8 of the two ends of a strap 6 are fastened to the internal face of the corresponding floater 2, 3 located inside the boat. The free ends of the two strands of the strap 6 can be folded over the external strand portion of the strap and held to it by appropriate means so that they are not freely hanging.

Figures 3, 4:
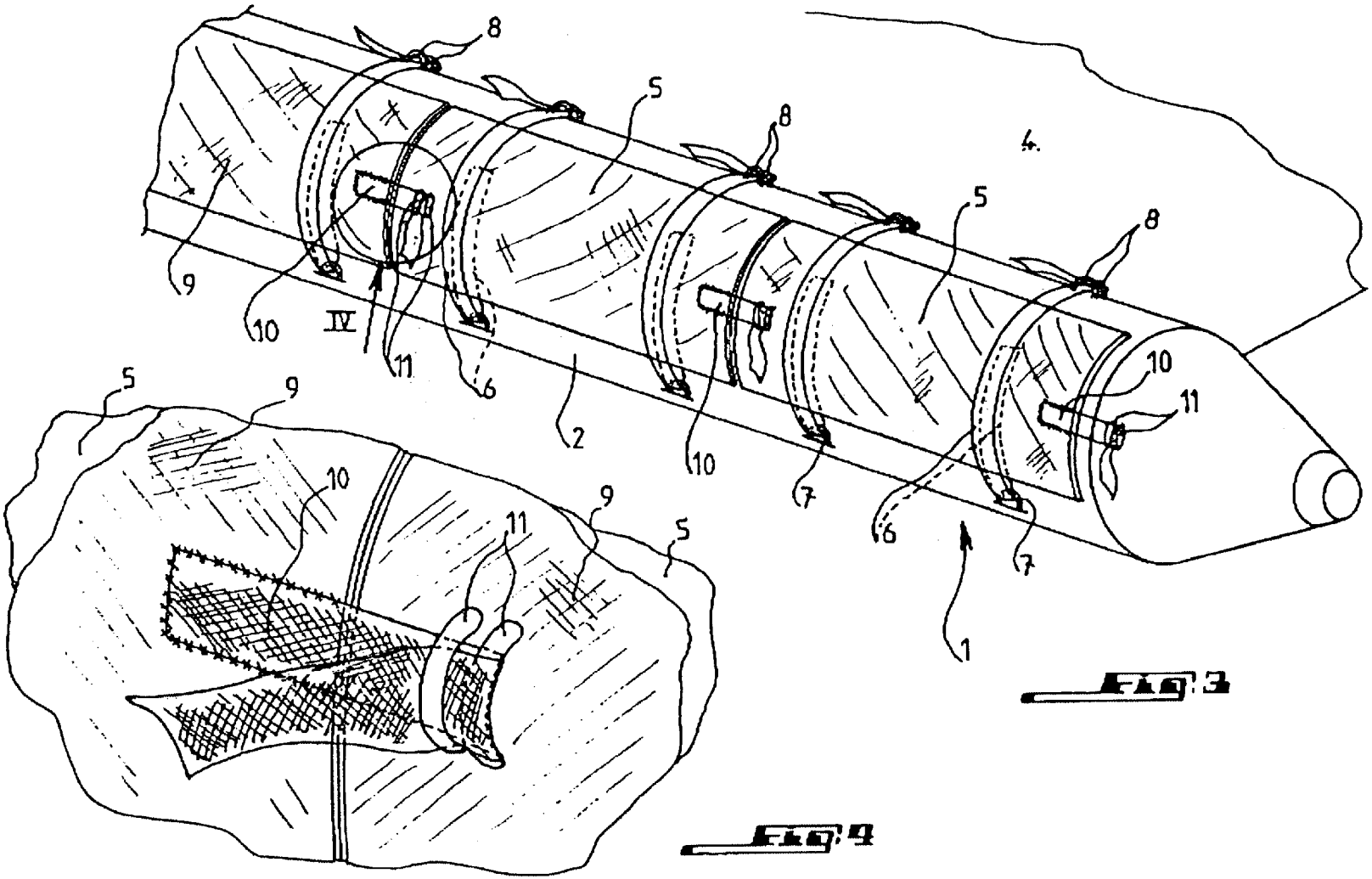
FIG. 3 is a partial perspective view representing in a detailed manner the fastening of the shielding plates to a floater of the inflatable boat.
FIG. 4 is an enlarged view of the circled part at IV of FIG. 3.

It is preferred, as shown only in FIG. 4, for each shielding plate 5 to be enclosed in a cover 9 made of a fabric based on Hypalon™ and neoprene resulting in tightened close contact with the external face and the internal face of the shielding plate 5. In this case, each strap made of fabric 6, is fastened by its internal strand to the corresponding internal face of the cover 9 which is in contact with the corresponding external face of the floaters 2, 3 and, naturally, the other external strand of the strap 6 is in contact on the external face of the cover. Advantageously, the cover has a fabric which is fastened by gluing to the corresponding shielding plate 5.

The adjacent shielding plates 5 are attached two by two to each other by a detachable connection means consisting of a strap 10 which extends longitudinally with respect to the floaters 2, 3 and which has one of its ends sewn to the external face of the cover 9 containing one of the adjacent shielding plates 5, while the opposite end of the strap 10 engages two rings 11, which are integrally connected to the external face of the other adjacent shielding plate 5, by traversing the associated cover 9, to tighten and lock the end of the strap 10 by friction, as is known and represented in FIG. 4.

Naturally, in the absence of a cover, each strap connecting two adjacent shielding plates 5 will have one of its ends integrally connected to one of the two plates and its other end passing through the two locking rings 11 which are integrally connected to the other plate.

It is preferred for the straps 10 for connecting shielding plates 5 to be located in the vicinity of the top part of the plates 5 to be accessible to a person in the boat.

As shown in the figures, the connecting straps 10 for connecting the shielding plates 5 which are fastened to the side floaters 2 have their ends fastened to the corresponding plates 5 located toward the front, in the direction of movement of the boat, while the opposite ends of the straps fastened to the rings 11 are directed toward the back of the boat. In other words, the tightening of the straps 10 occurs from the front to the back of the boat in the direction the boat travels in water during the displacement of the boat.

The rings 7, 8 and 11 are made of stainless steel.

The shielding plates 5 ensure a protection of the boat starting approximately at the peak of the floaters 2, 3 and descending, on the side of the boat, practically to its flotation line.

As an example, each plate can have a length of approximately 1 m and a width or height of approximately 40 cm.

Advantageously, each shielding plate 5 is made of a composite material based on polyethylene with unidirectional fibers which do not cross and of resin, preferably of the vinyl ester type, where the composite material comprises 80 wt % polyethylene and approximately 20 wt % resin.

This material can comprise four layers with unidirectional fibers made of polyethylene which are connected by the resin, where each polyethylene layer has unidirectional fibers which are oriented at 90° with respect to the unidirectional fibers of an adjacent layer.

For information, the composite material can have a thickness of 18 mm and a weight of 17 kg per $m^2$ so that, to protect the external part of an inflatable boat with a length of 6.40 m 6.6 $m^2$ of this material will be sufficient, which will be reflected in an overloading of the inflatable boat of approximately 113 kg.

The above described shielding device of the invention ensures an excellent resistance to the impacts of ordnance having a caliber of NATO 7.62, NATO 5.56 and 7.62×39. without causing an overloading of the boat in comparison to the protection material made of ceramics used earlier which caused excess weight of the craft due to an excess weight which is practically three times greater than that resulting from the shielding device of the invention. In other words, the principal qualities of the inflatable boat, namely its lightness, its rapid speed of displacement and its stability on the water, are maintained in spite of the presence of the shielding plates of the invention. Finally, the shielding plates accommodated in their respective covers can be easily mounted on the floaters of the boat and disconnected from the latter, without the need of special tools, since the operator merely has to tighten or loosen the fastening straps of the covers or of the floaters.

What is claimed is:

1. A shielding device for protection of floaters of an inflatable boat, the shielding device comprising shielding plates attachable along respective lengths to the floaters and resistant to impacts of ordnance.

2. The shielding device according to claim 1, including at least one strap, wherein each shielding plate is transversely removably fastenable to an external face of a floater by the at least one strap holding the plate to the floater by passing through an attachment ring fastened to the floater and under the plate, and having two free ends for engaging two tightening rings fastened to an internal face of a floater, inside the boat.

3. The shielding device according to claim 2, including two longitudinally spaced straps on each shielding plate wherein each shielding plate is fastenable to an external face of a corresponding floater with the two longitudinally spaced straps for transversely holding the shielding plate to the floater by passing through two attachment rings attached to the floater, under a bottom part of the plate, each strap having two free ends for engaging two tightening rings attached to the internal face of the floater, inside the boat.

4. The shielding device according to claim 2, including a fabric cover enclosing each shielding plate, and wherein each strap is made of fabric, and has an internal strand sewn to an internal face of the cover for contact with an external face of the floater, and an external strand in contact with an external face of the cover.

5. The shielding device according to claim 4, wherein the cover includes at least one of Hypalon™ and neoprene.

6. The shielding device according to claim 4, including detachable connection means for fastening adjacent shielding plates to each other.

7. The shielding device according to claim 6, wherein each detachable connection means for connecting adjacent shielding plates comprises a strap which extends longitudinally with respect to a floater and has a first end sewn to the external face of the cover containing a first of the adjacent shielding plates, while a second end of the strap is engaged with two tightening rings which are integrally connected to an external face of a second adjacent shielding plate by traversing the cover covering the second shielding plate.

8. The shielding device according to claim 7, wherein each strap for connecting the adjacent shielding plates has one end sewn to the cover and directed toward a first direction relative to the boat and an opposite end engaged in the two rings directed toward a second direction relative to the boat and opposite the first direction.

9. The shielding device according to claim 1, wherein the shielding plates are molded and match an external shape of a floater.

10. The shielding device according to claim 1, wherein the shielding plates descend approximately to a flotation line of the boat.

11. The shielding device according to claim 1, wherein each shielding plate is a composite material of polyethylene containing unidirectional fibers, and a vinyl ester resin.

12. The shielding device according to claim 11, wherein the composite material comprises approximately 80 wt % polyethylene and approximately 20 wt % vinyl ester resin.

13. The shielding device according to claim 11, wherein the composite material comprises four layers of polyethylene fibers with the fibers of one layer oriented at 90° with respect to the unidirectional fibers of an adjacent layer.

14. The shielding device according to one of claim 11, wherein the composite material has a weight of about 17 kg per $m^2$.

* * * * *